US011363921B2

(12) United States Patent
Yuen et al.

(10) Patent No.: US 11,363,921 B2
(45) Date of Patent: Jun. 21, 2022

(54) HANDHELD VACUUM CLEANER

(71) Applicant: TTI (Macao Commercial Offshore) Limited, Macau (MO)

(72) Inventors: Alvin Au Yeuk Yuen, Kwun Tong (HK); Benson Chun Kit Cheung, Kwai Chung (HK)

(73) Assignee: Techtronic Floor Care Technology Limited, Tortola (VG)

( * ) Notice: Subject to any disclaimer, the term of this patent is extended or adjusted under 35 U.S.C. 154(b) by 551 days.

(21) Appl. No.: 16/327,948

(22) PCT Filed: Feb. 27, 2017

(86) PCT No.: PCT/CN2017/075036

§ 371 (c)(1),
(2) Date: Feb. 25, 2019

(87) PCT Pub. No.: WO2018/036126

PCT Pub. Date: Mar. 1, 2018

(65) Prior Publication Data

US 2019/0183300 A1 Jun. 20, 2019

(30) Foreign Application Priority Data

Aug. 26, 2016 (CN) ..... 201630427729.7
Aug. 26, 2016 (CN) ..... 201630428523.6
(Continued)

(51) Int. Cl.
*A47L 5/24* (2006.01)
*A47L 5/26* (2006.01)
(Continued)

(52) U.S. Cl.
CPC ..... *A47L 5/24* (2013.01); *A47L 5/26* (2013.01); *A47L 9/122* (2013.01); *A47L 9/165* (2013.01);
(Continued)

(58) Field of Classification Search
CPC ... A47L 5/24; A47L 5/26; A47L 9/122; A47L 9/1608; A47L 9/165; A47L 9/1666;
(Continued)

(56) References Cited

U.S. PATENT DOCUMENTS 5,504,970 A 4/1996 Neshat et al.
5,787,546 A 8/1998 Bass et al.
(Continued)

FOREIGN PATENT DOCUMENTS

CN 1502296 A 6/2004
CN 2812826 Y 9/2006
(Continued)

OTHER PUBLICATIONS

Chinese Patent Office First Office Action for Application No. 201780066351.4 dated Sep. 16, 2020 (6 pages including statement of relevance).
(Continued)

*Primary Examiner* — Andrew A Horton
(74) *Attorney, Agent, or Firm* — Michael Best & Friedrich LLP

(57) ABSTRACT

A handheld vacuum cleaner (10), including a main body (22) having a handle (98), a motor assembly (114) positioned within the main body, and a cyclonic separator assembly (26) removably coupled to the main body. The cyclonic separator assembly includes an inlet nozzle (42) having a dirty air inlet (14) positioned in the front of the handheld vacuum cleaner when the cyclonic separator assembly is coupled to the main body, and a cyclonic chamber (30) in fluid communication with the dirty air inlet. The cyclonic chamber defines a separator axis (34). The cyclonic separator assembly further includes a dirt collection region (38) configured to receive debris separated in the cyclonic chamber. The inlet nozzle includes an upstream height (270)
(Continued)

measured perpendicular to the inlet axis and a downstream height (274) measured parallel to the separator axis. The downstream height is larger than the upstream height.

17 Claims, 13 Drawing Sheets

(30) Foreign Application Priority Data

Nov. 21, 2016 (CN) ..... 201630563988.2
Nov. 21, 2016 (CN) ..... 201630564174.0

(51) Int. Cl.

| | |
|---|---|
| ***A47L 9/12*** | (2006.01) |
| ***A47L 9/16*** | (2006.01) |
| ***A47L 9/28*** | (2006.01) |
| ***A47L 9/32*** | (2006.01) |
| ***B04C 5/04*** | (2006.01) |
| ***B04C 5/081*** | (2006.01) |
| ***B04C 5/185*** | (2006.01) |
| ***B04C 9/00*** | (2006.01) |

(52) U.S. Cl.
CPC ..... *A47L 9/1608* (2013.01); *A47L 9/1666* (2013.01); *A47L 9/2884* (2013.01); *A47L 9/322* (2013.01); *B04C 5/04* (2013.01); *B04C 5/081* (2013.01); *B04C 5/185* (2013.01); *B04C 9/00* (2013.01); *B04C 2009/002* (2013.01)

(58) Field of Classification Search
CPC ..... A47L 9/2884; A47L 9/322; B04C 5/04; B04C 5/081; B04C 5/185; B04C 9/00; B04C 2009/002
See application file for complete search history.

(56) References Cited

U.S. PATENT DOCUMENTS

| | | | | |
|---|---|---|---|---|
| D582,114 | S | 12/2008 | Dyson | |
| 8,146,201 | B2 | 4/2012 | Conrad | |
| D669,823 | S | 10/2012 | Uibomäe | |
| 8,387,204 | B2 * | 3/2013 | Dyson | A47L 9/2884 15/344 |
| 9,066,643 | B2 | 6/2015 | Conrad | |
| 9,078,549 | B2 | 7/2015 | Conrad | |
| 9,084,522 | B2 | 7/2015 | Conrad | |
| 9,084,524 | B2 | 7/2015 | Conrad | |
| 9,095,245 | B2 | 8/2015 | Conrad | |
| 9,119,514 | B2 | 9/2015 | Conrad | |
| 9,820,621 | B2 | 11/2017 | Conrad et al. | |
| 2005/0273969 | A1 | 12/2005 | Watson et al. | |
| 2008/0216282 | A1 | 9/2008 | Conrad | |
| 2012/0079671 | A1 * | 4/2012 | Stickney | A47L 5/225 15/344 |
| 2014/0208538 | A1 | 7/2014 | Visel et al. | |
| 2016/0015230 | A1 * | 1/2016 | Conrad | A47L 5/24 15/344 |
| 2017/0071426 | A1 | 3/2017 | Krebs et al. | |
| 2017/0196419 | A1 | 7/2017 | Brown et al. | |
| 2017/0290481 | A1 | 10/2017 | Conrad | |

FOREIGN PATENT DOCUMENTS

| | | | |
|---|---|---|---|
| CN | 101032384 | A | 9/2007 |
| CN | 101677727 | A | 3/2010 |
| CN | 101756675 | A | 6/2010 |
| CN | 101919673 | A | 12/2010 |
| CN | 204274320 | U | 4/2015 |
| CN | 204363891 | U | 6/2015 |
| CN | 205433556 | U | 8/2016 |
| JP | H1176119 | A | 3/1999 |
| JP | 2015097663 | A | 5/2015 |
| WO | 2012119226 | A1 | 9/2012 |

OTHER PUBLICATIONS

European Patent Office Extended Search Report for Application No. 17842552.6 dated Feb. 28, 2020 (8 pages).
International Search Report and Written Opinion for Application No. PCT/CN2017/075036 dated May 17, 2017, 7 pages.

* cited by examiner

HANDHELD VACUUM CLEANER

CROSS-REFERENCE TO RELATED APPLICATIONS

This application claims priority to Chinese Design Application No. 201630428523.6, filed on Aug. 26, 2016; Chinese Design Application No. 201630427729.7, filed on Aug. 26, 2016; Chinese Design Application No. 201630564174.0, filed on Nov. 21, 2016; and Chinese Design Application No. 201630563988.2, filed on Nov. 21, 2016. The entire contents of each are hereby incorporated by reference.

BACKGROUND

The present invention relates to handheld vacuum cleaners, and more particularly, to cyclonic handheld vacuum cleaners.

SUMMARY

In one embodiment, the invention provides a handheld vacuum cleaner including a main body having a handle, a motor assembly positioned within the main body; and a cyclonic separator assembly removably coupled to the main body. The cyclonic separator assembly includes an inlet nozzle having a dirty air inlet positioned a front of the handheld vacuum cleaner when the cyclonic separator assembly is coupled to the main body, and a cyclonic chamber in fluid communication with the dirty air inlet. The cyclonic chamber defines a separator axis. The cyclonic separator assembly further includes a dirt collection region configured to receive debris separated in the cyclonic chamber. The inlet nozzle includes an upstream height measured perpendicular to the inlet axis and a downstream height measured parallel to the separator axis. The downstream height is larger than the upstream height.

Other aspects of the invention will become apparent by consideration of the detailed description and accompanying drawings.

Figure 1:
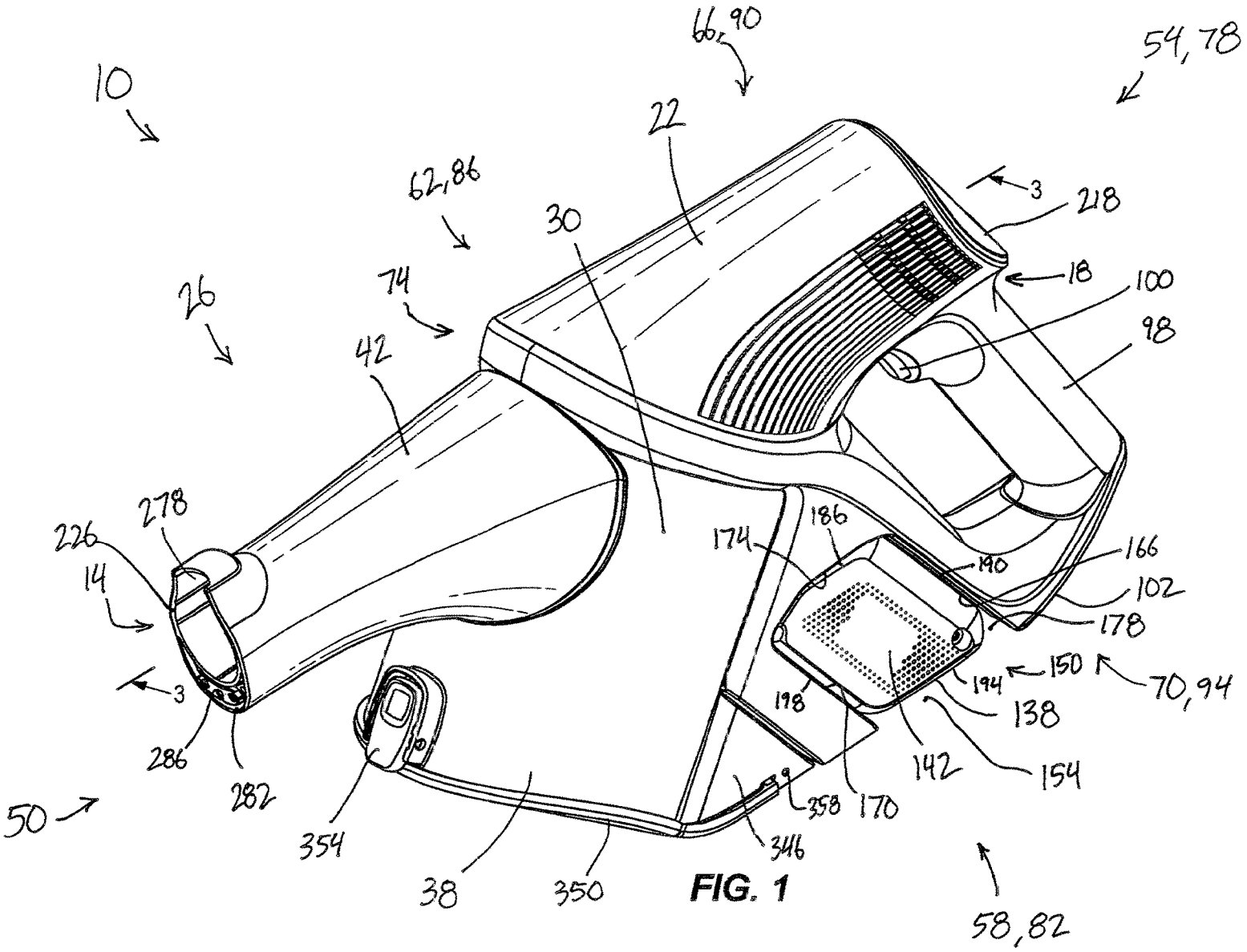
FIG. 1 is a perspective view of a handheld vacuum cleaner according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-8 illustrate a handheld vacuum cleaner 10. The handheld vacuum cleaner 10 includes a fluid flow path extending from a dirty air inlet 14 to a clean air outlet 18. The handheld vacuum cleaner 10 also includes a main body 22 (i.e., a main housing) and a cyclonic separator assembly 26 removably coupled to the main body 22. The cyclonic separator assembly 26 includes a cyclonic chamber 30 that defines a separator axis 34, a dirt collection region 38, and an inlet nozzle 42 that defines an inlet axis 46. The handheld vacuum cleaner 10 includes a front 50, a rear 54, a first lateral side 58, a second lateral side 62, a top 66, and a bottom 70. Similarly, the main body 22 includes a front 74, a rear 78, a first lateral side 82, a second lateral side 86, a top 90, and a bottom 94. In the illustrated embodiment, the dirty air inlet 14 is positioned at the front 50 of the handheld vacuum cleaner 10 and the clean air outlet 18 is positioned on the first and second lateral sides 58, 62 toward the rear 54 of the handheld vacuum 10. As described in greater detail below, the dirty air inlet 14 extends along the inlet axis 46.

Figure 2:
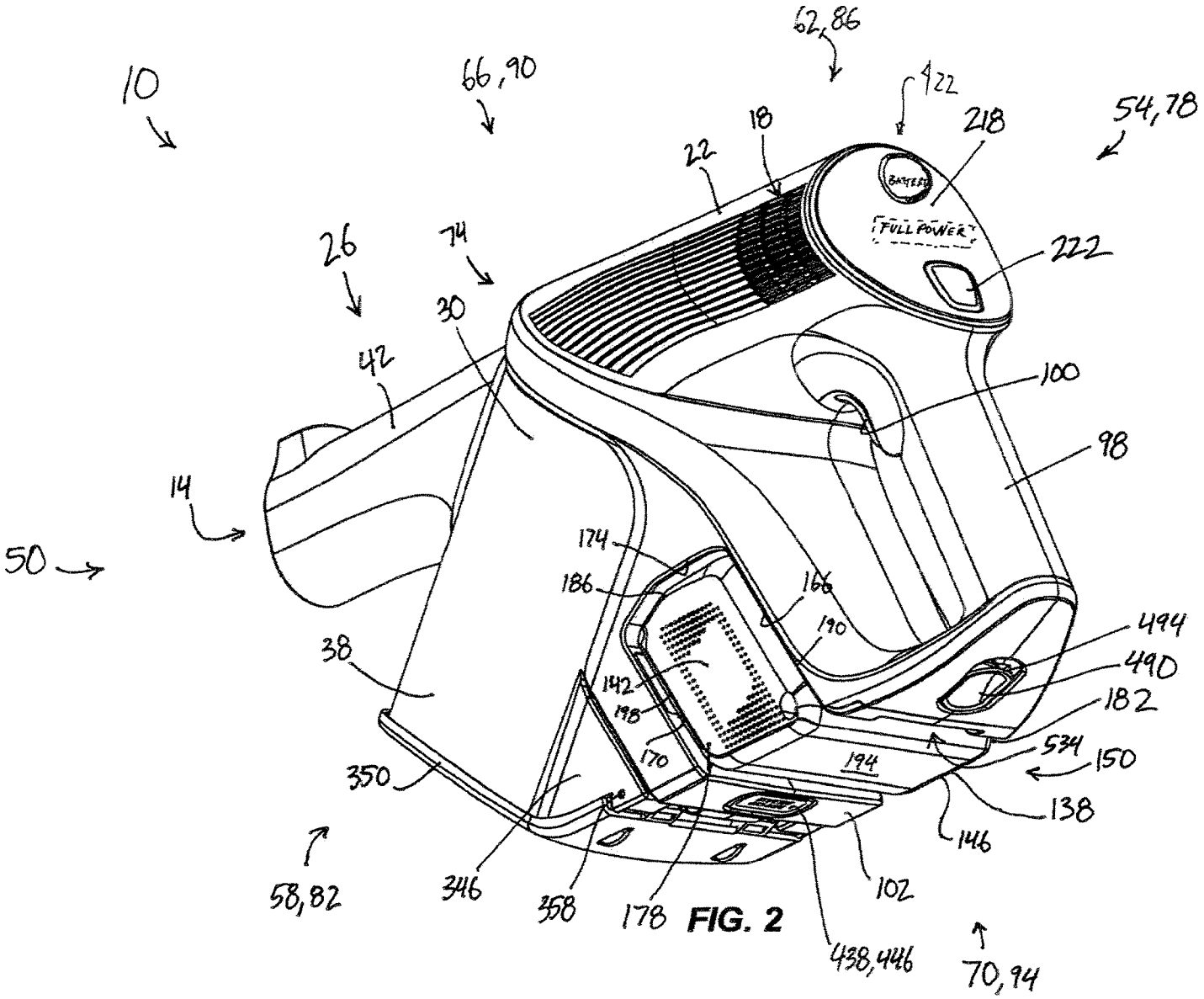
FIG. 2 is another perspective view of the handheld vacuum cleaner of FIG. 1.
Figure 3:
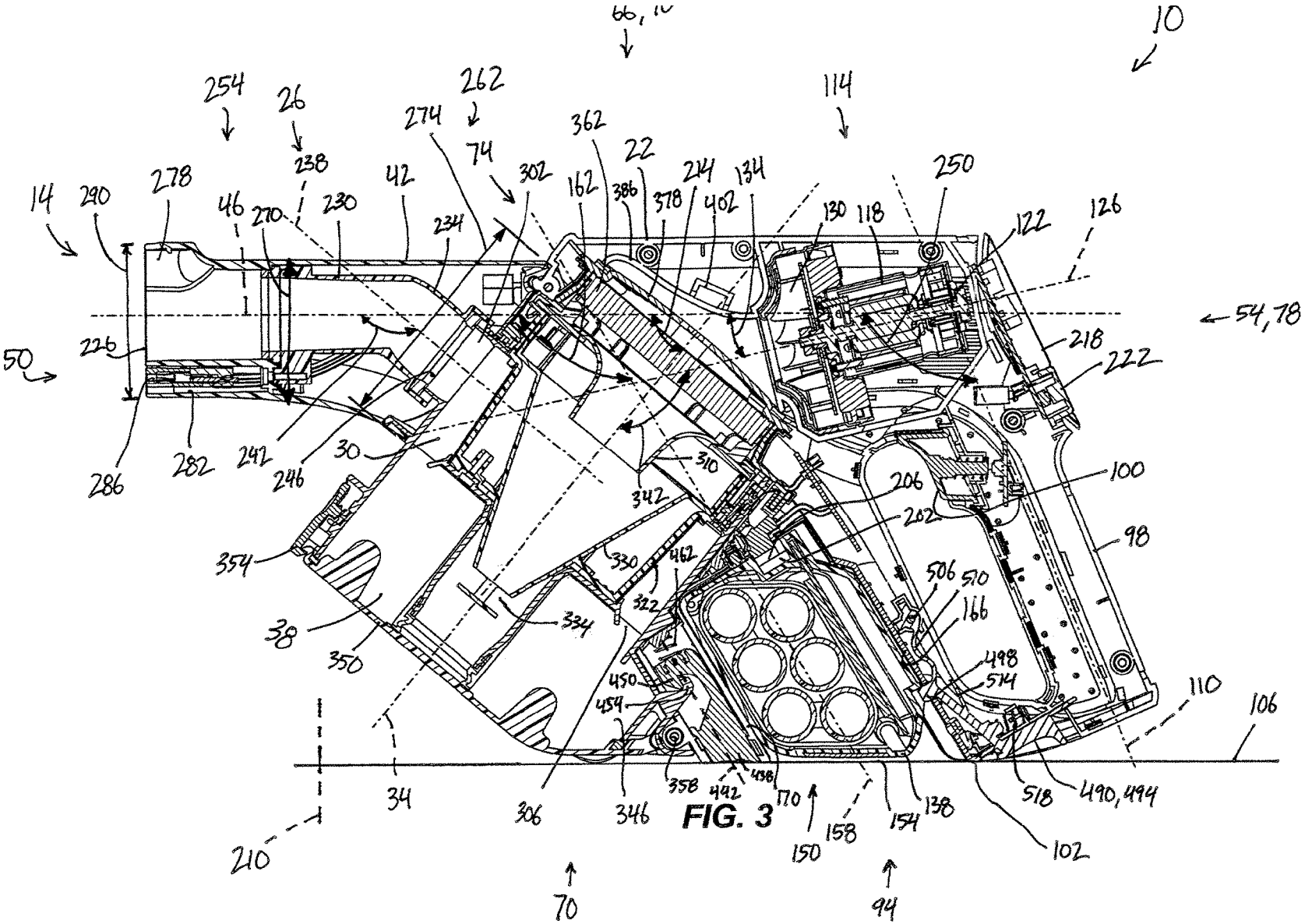
FIG. 3 is a cross-sectional view of the handheld vacuum cleaner of FIG. 1, taken along lines 3-3 shown in FIG. 1.

With reference to FIGS. 1-3, the main body 22 includes a handle 98 and a bottom surface 102 on the bottom 94, upon which the handheld vacuum cleaner 10 is configured to be positioned on (i.e., supported on, rested on) a horizontal surface 106 (FIG. 3). The handle 98 of the main body 22 extends along a handle axis 110 (FIG. 3) and includes a trigger 100. The handheld vacuum cleaner 10 further includes a motor assembly 114 positioned within the main body 22 and operable to generate an airflow through the fluid flow path. In particular, the motor assembly 114 includes a motor 118 with a motor shaft 122 defining a motor rotational axis 126 and a fan 130 coupled to the motor shaft 122 for co-rotation. In the illustrated embodiment, the handle axis 110 interests the motor assembly 114. In addition, the motor rotational axis 126 intersects the inlet axis 46. In other words, the inlet axis 46 intersects the motor assembly 114. In particular, the motor rotational axis 126 intersects the inlet axis 46 forming an acute angle 134 (FIG. 3) extending between the dirty air inlet 14 and the motor 118 (i.e., counter-clockwise from the inlet axis 46 as viewed from FIG. 3). In the illustrated embodiment, the inlet axis 46 intersects the handle axis 110 but does not intersect the handle 98.

For the purpose of the description herein, two axes intersecting to form an angle includes two axes that are non-parallel and intersect as viewed in at least one plane. In some embodiments, two axes intersecting to form an angle may include two axes that are co-planar and that intersect at a single point. In other embodiments, the two axes intersecting to form an angle may include two axes that are skewed with respect to each other (i.e., not co-planar), but the axes intersect as viewed from a certain perspective (e.g., a side view, a top view, etc.).

With continued reference to FIGS. 1-3, the handheld vacuum cleaner 10 includes a battery 138 (i.e., a removable, rechargeable battery pack) to supply power to the motor assembly 114 and other electrical components. The battery 138 includes a first side surface 142 and a second side surface 146 opposite the first side surface 142. The main body 22 includes a receptacle 150 having an inlet 154 to receive the battery 138. In other words, the battery 138 is configured to be selectively received within the receptacle 150. As described in greater detail below, the battery 138 is inserted into the receptacle 150, through the inlet 154, along a battery insertion axis 158. In other words, the main body 22 is configured such that the battery 138 is insertable into the receptacle 150 through the bottom surface 102. In addition, at least a portion of the battery 138 is positioned between the cyclone chamber 30 and the bottom surface 102.

With reference to FIG. 3, the battery insertion axis 158 intersects the separator axis 34. In addition, the battery insertion axis 158 is offset from and in some embodiments parallel to the handle axis 110. In alternative embodiments, the battery insertion axis is along the separator axis and intersects the handle axis (e.g., FIG. 14). Also, the motor rotational axis 126 intersects the battery insertion axis 158. Furthermore, the battery insertion axis 158 intersects the inlet axis 46. In particular, the battery insertion axis 158 intersects the inlet axis 46 to form an obtuse angle 162 extending between the dirty air inlet 14 and the battery 138 (i.e., counter-clockwise from the inlet axis 46 as viewed from FIG. 3).

In the illustrated embodiment, the receptacle 150 is defined by a first wall 166, a second wall 170 opposite the first wall 166, and a curved third wall 174 extending between the first wall 166 and the second wall 170. In the illustrated embodiment, the first wall 166 and the second wall 170 are only connected by the third wall 174. In other words, in the illustrated embodiment, the receptacle 150 includes a first aperture 178 at the first lateral side 82 of the main body 22 and a second aperture 182 at the second lateral side 86 of the main body 22. Moreover, the first aperture 178 and the second aperture 182 extend toward the receptacle inlet 154 such that the battery 138 is graspable by a user between the installed position (i.e., with the battery 138 fully inserted into the receptacle 150, e.g., FIG. 5A) and the removed position (i.e., with the battery 138 at least partially removed from the receptacle 150, e.g., FIG. 5B). In the illustrated embodiment, the first aperture 178 and the second aperture 182 are continuous with the receptacle inlet 154. In other words, the apertures 178, 182 and the inlet 154 form a slot that is open to the first lateral side 82 of the main body 22, open to the second lateral side 86 of the main body 22, and open to the bottom 94 of the main body 22. The first side surface 142 and the second side surface 146 of the battery 138 extend parallel to the insertion axis 158 when the battery 138 is positioned within the receptacle 150. In alternative embodiments, the apertures 178, 182 are not continuous with the receptacle inlet 154 or are only partially continuous with the receptacle inlet 154 yet still configured for the battery to be graspable, or engaged by, a user through the apertures, for example to aid in insertion and removal of the battery.

When the battery 138 is positioned within the receptacle 150, each of the first side surface 142 and the second side surface 146 of the battery 138 are substantially exposed through the apertures 178, 182 at the respective first and second lateral sides 82, 86 of the main body 22 such that the first and second side surfaces 142, 146 are graspable by a user. In some embodiments, the first side surface 142 and the second side surface 146 are substantially exposed with at least 25 percent of the surfaces 142, 146 exposed through the apertures 178, 182 at the respective first and second lateral sides 82, 86 of the main body 22. In other embodiments, the first side surface 142 and the second side surface 146 are substantially exposed with at least 50 percent of the surfaces 142, 146 exposed through the apertures 178, 182 at the respective first and second lateral sides 82, 86 of the main body 22. In other embodiments, the first side surface 142 and the second side surface 146 are substantially exposed with at least 75 percent of the surfaces 142, 146 exposed through the apertures 178, 182 at the respective first and second lateral sides 82, 86 of the main body 22. In other embodiments, the first side surface 142 and the second side surface 146 are substantially exposed with 100 percent of the surfaces 142, 146 exposed through the apertures 178, 182 at the respective first and second lateral sides 82, 86 of the main body 22 (i.e., entirely exposed). As such, the battery 138 is readily graspable by a user (i.e., at the first and second side surfaces 142, 146) when the battery 138 is positioned within the receptacle 150.

With reference to FIGS. 1-3, the battery 138 further includes a first surface 186, a second surface 190, a third surface 194, and a fourth surface 198 each extending between the first side surface 142 and the second side surface 146. In the illustrated embodiment, the first surface 186 is opposite the third surface 194 and the second surface 190 is opposite the fourth surface 198. At least one of the first surface 186, second surface 190, and fourth surface 198 includes an electrical contact 202 that is selectively electrically connected to a corresponding electrical contact 206 formed in the receptacle 150. In the illustrated embodiment, the electrical contact 206 in the receptacle 150 is formed on the third wall 174 of the receptacle 150 corresponding to the electrical contact 202 on the first surface 186.

When the battery 138 is positioned within the receptacle 150, the third surface 194 of the battery 138 is substantially exposed such that the third surface 194 is in the direction of the receptacle inlet 154 (i.e., exposed at the bottom surface 102 of the main body 22). In some embodiments, the third surface 194 of the battery 138 is entirely exposed. Alternatively, the receptacle inlet 154 may be selectively closed by a cover or door that at least partially covers the third surface 194 of the battery. Also when the battery 138 is positioned within the receptacle 150, the first surface 186, the second surface 190, and the fourth surface 198 are in facing relationship with the main body 22. More specifically, the first surface 186 is in facing relationship with the third wall 174 of the main body 22, the second surface 190 is in facing relationship with the first wall 166 of the main body 22, and the fourth surface 198 is in facing relationship with the second wall 170 of the main body 22. Moreover, when the battery 138 is positioned within the receptacle 150, at least a portion of the battery 138 is positioned between the cyclonic chamber 30 and the handle 98. In other words, the receptacle 150 is formed in the main body 22 between at least a portion of the cyclonic separator assembly 26 (e.g., the cyclonic chamber 30) and the handle 98.

Figure 14:
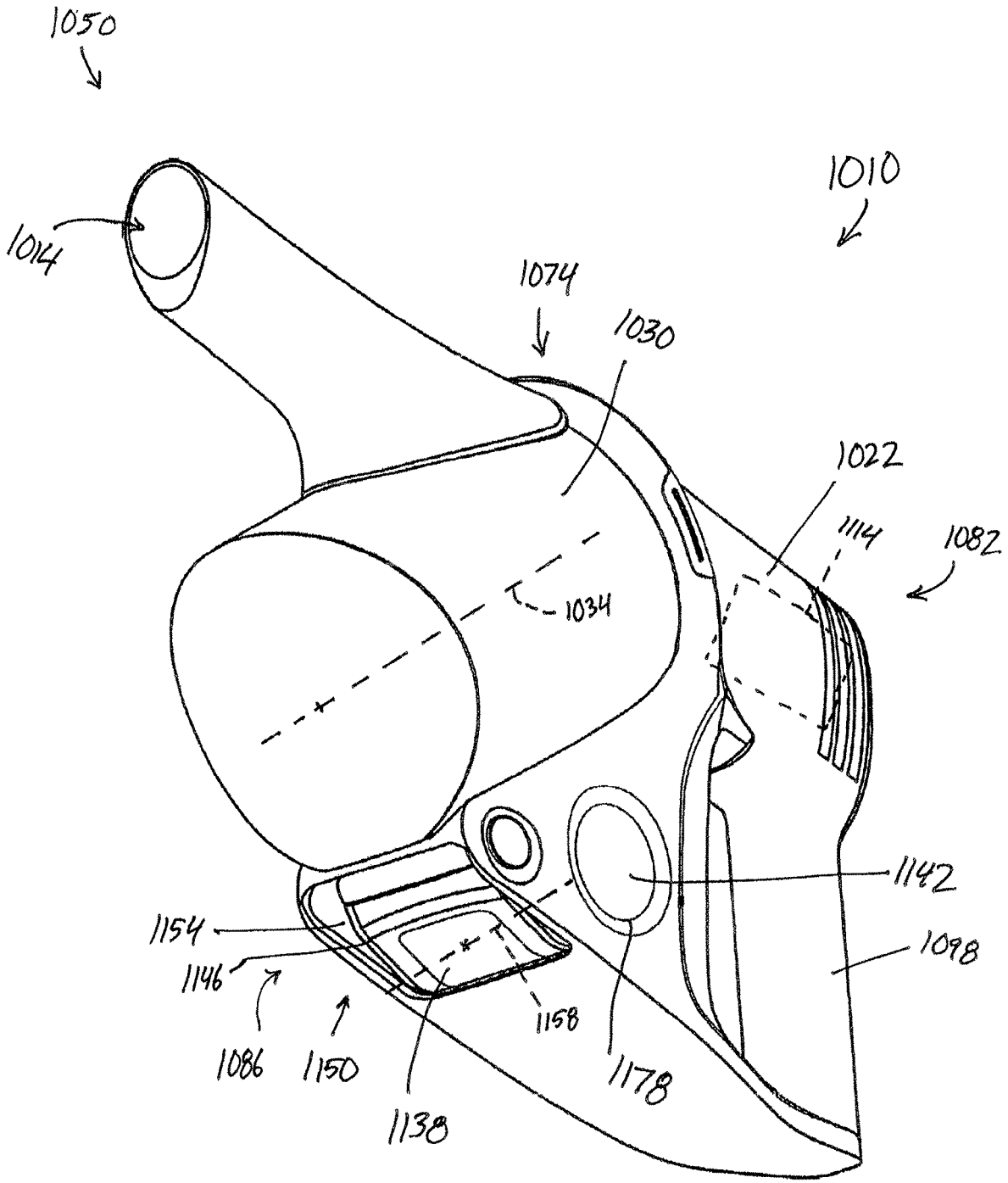
FIG. 14 is a bottom perspective view of a handheld vacuum cleaner according to another embodiment of the invention.

With reference to FIG. 14, a handheld vacuum cleaner 1010 according to an alternative embodiment is illustrated. The handheld vacuum cleaner 1010 is similar to the handheld vacuum cleaner 10, with only the differences described herein. In particular, the handheld vacuum cleaner 1010 includes a main body 1022 including a front 1074, a first lateral side 1082, a second lateral side 1086, a handle 1098, and a receptacle 1150 having an inlet 1154. The handheld vacuum cleaner 1010 also includes a motor assembly 1114 positioned within the main body 1022, a dirty air inlet 1014 positioned at a front 1050 of the handheld vacuum cleaner 1010, and a cyclonic chamber 1030 in fluid communication with the dirty air inlet 1014 and the motor assembly 1114. The handheld vacuum cleaner 1010 also includes a battery 1138 having a first side surface 1142 and a second side surface 1146 opposite the first side surface 1142. Similar to the battery 138, the battery 1138 is configured to be selectively received through the receptacle inlet 1154 and movable by a user between an installed position in the receptacle 1150 and a removed position separate from the main body 1022.

With continued reference to FIG. 14, the main body 1022 includes a first aperture 1178 through the first lateral side 1082 aligned with at least a portion of the battery first side surface 1142 when the battery 1138 is positioned within the receptacle 1150. At least a portion of the battery first side surface 1142 is viewable by a user through the first aperture 1178 when the battery 1138 is positioned within the receptacle 1150. The main body 1022, in some embodiments, may include a second aperture (not shown) through the second lateral side 1086. The second aperture may be a mirror image of the first aperture 1178 aligned with at least a portion of the battery second side surface 1146 when the battery 1138 is positioned within the receptacle 1150. At least a portion of the battery second side surface 1146 is viewable by a user through the second aperture when the battery 1138 is positioned within the receptacle 1150. Each of the first side surface 1142 and the second side surface 1146 are at least 25 percent exposed at the lateral sides 1082, 1086 of the main body 1022 when the battery 1138 is positioned within the receptacle 1150, such that the first and second side surfaces 1142, 1146 are graspable by a user. Similar to the apertures 178, 182, the first aperture 1178 and the second aperture extend toward the receptacle inlet 1154 such that the battery 1138 is graspable by a user between the installed position and the removed position. As such, the apertures provide a visual indication to the user that the battery 1138 is installed within the receptacle 1150. The battery insertion axis 1158 is along and may be parallel to the separator axis 1034 in the alternative handheld vacuum cleaner 1010 of FIG. 14.

With reference to FIG. 3 and the handheld vacuum cleaner 10, when the bottom surface 102 is placed on the horizontal surface 106, the separator axis 34 is inclined relative to a vertical axis 210. In addition, the inlet axis 46 is within 10 degrees of horizontal when the bottom surface 102 is placed on the horizontal surface 106. In alternative embodiments, the inlet axis 46 is parallel with the horizontal surface 106 when the bottom surface 102 is placed on the horizontal surface 106.

Figure 4:
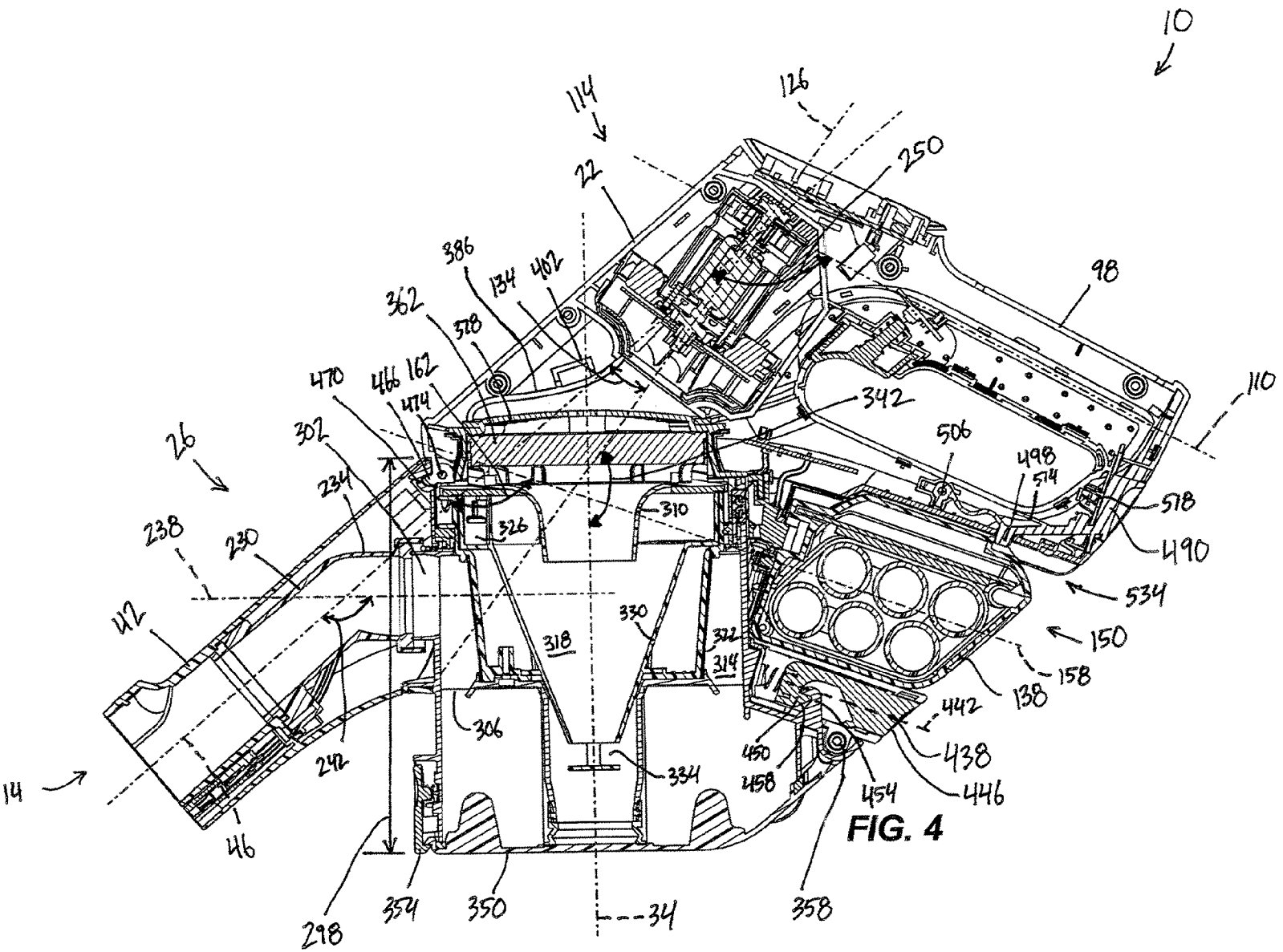
FIG. 4 is a cross-sectional view of the handheld vacuum cleaner of FIG. 1, shown in an in-use position with a separator axis oriented vertically.
Figure 13:
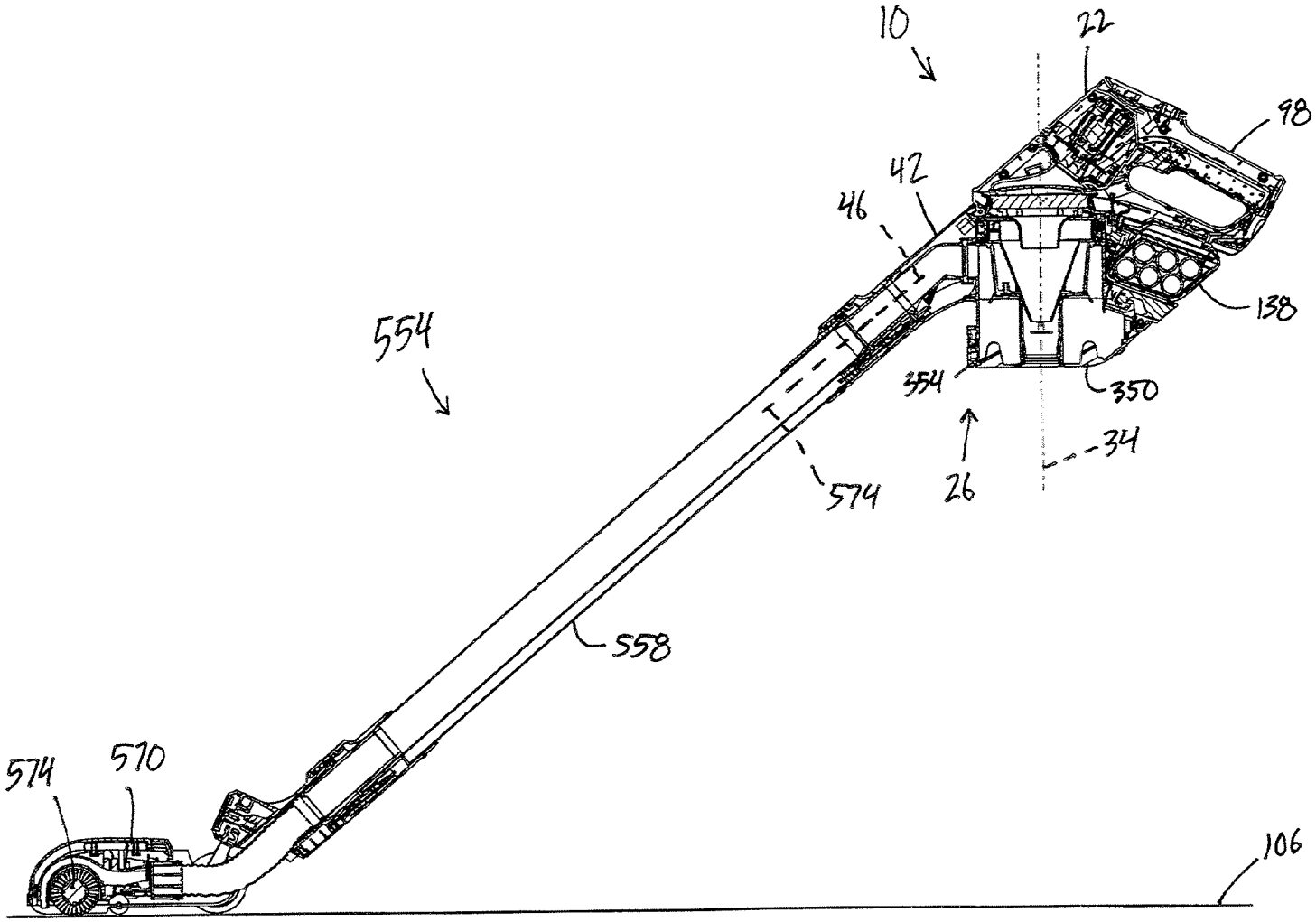
FIG. 13 is a cross-sectional view of the handheld vacuum cleaner and the surface cleaning attachment of FIG. 11 in an in-use position.

With reference to FIG. 4 and FIG. 13, the inlet axis 46 and the separator axis 34 intersect to form an acute angle 214 extending between the dirty air inlet 14 and the cyclonic chamber 30 (i.e., counter-clockwise from the inlet axis 46 as viewed from FIG. 3). The acute angle 214 is within the range of approximately 30 degrees to approximately 70 degrees such that when the handheld vacuum cleaner 10 is operated in a normal operating condition (e.g., FIG. 4, FIG. 13) with the dirty air inlet 14 pointed downwardly, the separator axis 34 is oriented vertically. In alternative embodiments, the acute angle 214 is within a range of approximately 40 degrees to approximately 60 degrees. In further embodiments, the acute angle 214 is within a range of approximately 45 degrees to approximately 55 degrees. In some embodiments, the acute angle 214 is approximately 50 degrees.

With reference to FIG. 2, the main body 22 includes a rear-facing surface 218 opposite the dirty air inlet 14. In other words, the rear-facing surface 218 is formed on the rear 78 of the main body 22 and faces a user during operation. A user interface 222 is positioned on the rear-facing surface 218 adjacent the handle 98. The user interface 222 may include a button, switch, touch screen, dial or other user-manipulative interface. In the illustrated embodiment, the user interface 222 includes a visual indicator or display 422 operable to display information on the user-facing surface 218. The visual indicator 422 may be a screen, LEDs, graphical interface, or other visual indicator. The user interface 222 is electrically connected to the battery 138 and a vacuum controller 410 and is connected to and operable to control and display information about features of the vacuum cleaner, for example battery life, power setting, system performance or other information. The user interface 222 may be connected to and operable to control and display information about features on attached accessory tools, such as brush motors or sensors. In the illustrated embodiment, the user-interface 222 may be configured to vary operation of a brushroll (e.g., brushroll 578 of FIG. 12). In particular, activation of the user-interface 222 varies operation of the brushroll between a carpet mode and a hard floor mode, or between a high brushroll speed and low or off brushroll speed.

The inlet nozzle 42 is positioned at the front 50 of the handheld vacuum cleaner 10 when the cyclonic separator assembly 26 is coupled to the main body 22. In the illustrated embodiment, the dirty air inlet 14 includes an inlet aperture 226 formed in the inlet nozzle 42. As part of the dirty air inlet 14, the inlet nozzle 42 houses a first air passage 230 (e.g., a first air tube) and a second air passage 234 (e.g., a second air tube) downstream of the first air passage 230. The first air passage 230 extends along the inlet axis 46 (i.e., a first axis), and the second air passage 234 defines a second axis 238 extending toward a cyclone inlet 302. The first axis 46 and the second axis 238 intersect to form an angle 242 as viewed from a vertical cross-section taken from a lateral side (e.g., 58, 62) of the handheld vacuum cleaner 10 (e.g., FIG. 3). In the illustrated embodiment, the second air passage 234 includes a tangential inlet 246 to the cyclonic chamber 30. In other words, the first air passage 230 extends from the front 50, while the second air passage 234 extends toward the bottom 70 and extends toward the first lateral side 58 toward the cyclone inlet 302 of the handheld vacuum cleaner 10.

With reference to FIG. 3, the inlet axis 46 and the handle axis 110 intersect to form an obtuse angle 250 extending between the dirty air inlet 14 and the handle 106. In other words, the angle 250 formed by the intersection of the inlet axis 46 and the handle axis 110 is greater than 90 degrees and less than 180 degrees, taken in a direction from the inlet axis 46 toward the handle 98 (i.e., counter-clockwise from the inlet axis 46 as viewed from FIG. 3)).

Figure 6:
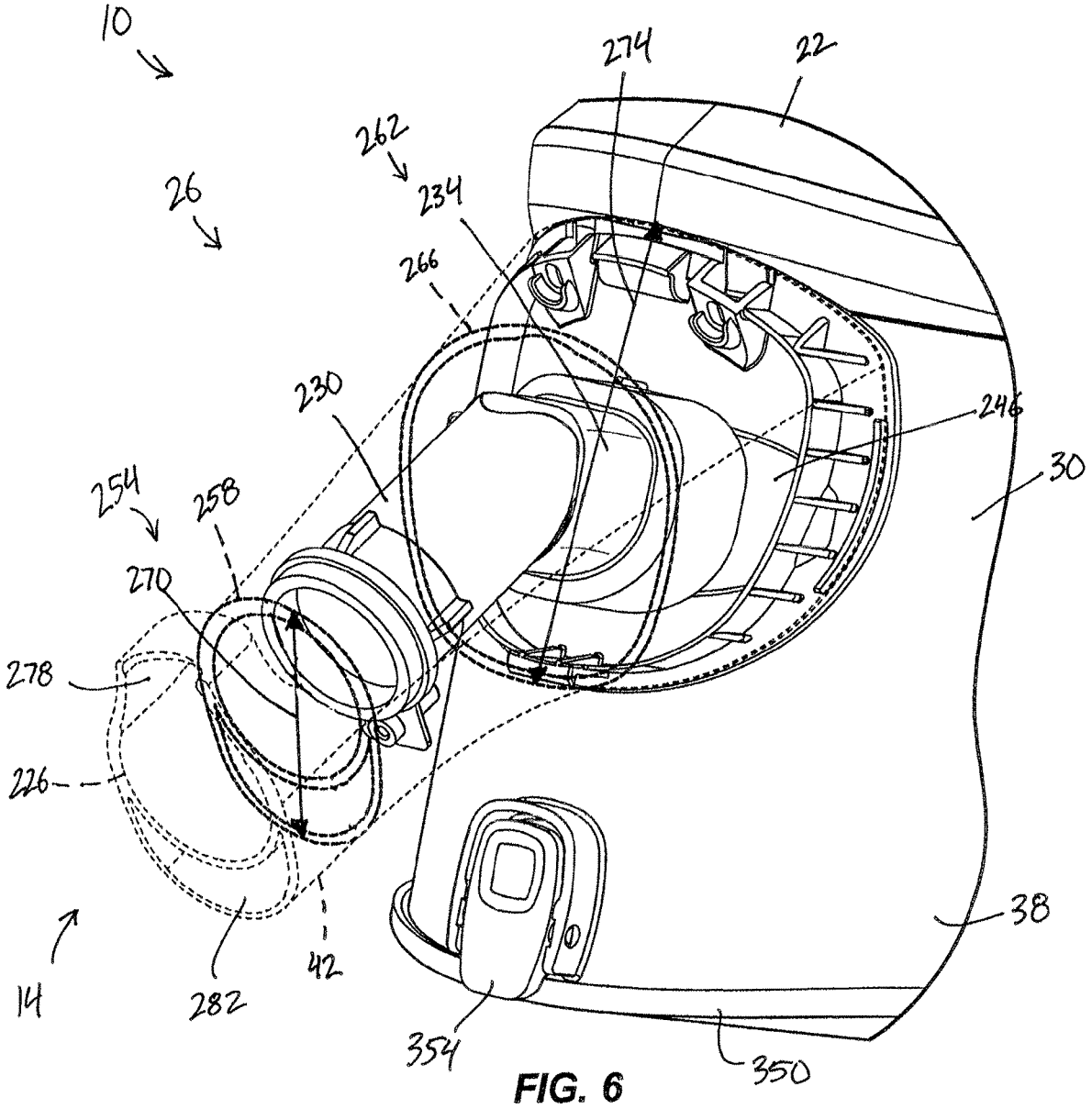
FIG. 6 perspective view of the handheld vacuum cleaner of FIG. 1, showing an inlet nozzle in phantom.

With reference to FIG. 6, the inlet nozzle 42 includes an upstream portion 254 having a first cross-sectional area 258 and a downstream portion 262 having a second cross-sectional area 266. The inlet nozzle 42 also includes an upstream height 270 measured perpendicular to the inlet axis 46 and a downstream height 274 measured parallel to the separator axis 34. The downstream height 274 is larger than the upstream height 270. In some embodiments, the downstream height 274 is at least 1.3 times larger than the upstream height 270. Alternatively, the downstream height 274 is at least 1.5 times larger than the upstream height 270. In some embodiments, the downstream height 274 is in the range from 1.5 to 3 times larger than the upstream height 270. In yet another embodiment, the downstream height 274 is at least 3 times larger than the upstream height 270. In other words, height of the inlet nozzle 42 increases in the downstream direction.

Generally, the upstream height 270 is measured at a location where the inlet nozzle 42 begins increasing in height in the downstream direction. In some embodiments, the upstream height 270 is measured at a height 290 at the inlet 14 (i.e., at the inlet aperture 226). In other embodiments, the upstream height 270 is measured between the inlet 14 and the downstream height 274. In the illustrated embodiment, the upstream end of the inlet nozzle 42 includes a space 278 for an accessory latch (e.g., the attachment 554 of FIG. 11) and a space 282 for an electrical connection 286. In other words, in some embodiments, the inlet nozzle 42 increases in height in the downstream direction, throughout the entire length of the inlet nozzle 42. In other embodiments, the inlet nozzle 42 increases in height in the downstream direction for at least a portion of the inlet nozzle 42 length. Said another way, the inlet nozzle height may increase in the upstream direction and in the downstream direction, with a minimum height therebetween. In the illustrated embodiment, the height 270 is approximately 53 millimeters. In some embodiments, the downstream height 274 is measured where the inlet nozzle 42 and the cyclonic chamber 30 meet (FIG. 3). In the illustrated embodiments, the downstream height 274 is approximately 90 millimeters.

With continued reference to FIG. 6, the second cross-sectional area 266 is at least 1.5 times larger than the first cross-sectional area 258. In alternative embodiments, the second cross-sectional area 266 is at least 3 times larger than the first cross-sectional area 258. With reference to FIGS. 3 and 4, the cyclonic separator assembly 26 defines a separator height 298 (FIG. 4) that extends along the separator axis 34, and the downstream height 274 (FIG. 3) parallel to the separator axis 34 is greater than one half of the separator height 298. In other words, the inlet nozzle 42 expands in both the horizontal direction (i.e., transverse the separator axis 34) and the vertical direction (i.e., parallel to the separator axis 34). The increased second cross-sectional area 266 (i.e., the increased downstream height 274) provides for improved structural integrity of the inlet nozzle 42 connection to the remaining portions of the cyclonic separator assembly 26. In other words, the size and shape of the inlet nozzle 42 provides improved strength and reliability of the inlet nozzle 42 connecting to the remaining portions of the cyclonic separator assembly 26.

The cyclonic chamber 30 is in fluid communication with the dirty air inlet 14 and the motor assembly 114. In addition, the cyclonic chamber 30 (i.e., the cyclonic separator) includes the cyclone dirty fluid inlet 302, a dirt outlet 306, and a clean fluid outlet 310. In the illustrated embodiment, the cyclonic chamber 30 includes a primary cyclonic stage 314 and a secondary cyclonic stage 318 positioned between the dirty fluid inlet 302 and the clean fluid outlet 310 (FIG. 4). In alternative embodiments, the cyclonic chamber 30 may include more or less than two cyclonic stages. In particular, the cyclonic chamber 30 includes a perforated shroud 322 through which air cleaned by the primary cyclonic stage 314 flows through. The secondary cyclonic stage 318 is positioned downstream of the perforated shroud 322 and the secondary cyclonic stage 318 includes a secondary dirty air tangential inlet 326 (FIG. 4), a secondary funnel 330, and a secondary dirt outlet 334. The air cleaned by the secondary cyclonic stage 318 flows to the clean fluid outlet 310. In alternative embodiments, the illustrated cyclonic chamber 30 can be replaced with alternative dirt separators (e.g., over-the-wall cyclonic separators, bagged separators, etc.)

As described above, the inlet axis 46 and the separator axis 34 intersect to form the acute angle 214 extending between the dirty air inlet 14 and the cyclonic chamber 30. In other words, the angle 214 formed by the intersection of the inlet axis 46 and the separator axis 34 is less than 90 degrees, taken in a direction from the inlet axis 46 toward the cyclonic chamber 30 (i.e., counterclockwise as viewed from FIG. 3). In addition, the separator axis 34 and the motor rotational axis 126 interest to form an obtuse angle 342 extending between the cyclonic chamber 30 and the motor assembly 114. In other words, the angle 342 formed by the intersection of the separator axis 34 and the motor rotational axis 126 is in a range from about 90 degrees to 180 degrees, taken in a direction from the cyclonic chamber 30 toward the motor assembly 114 (i.e., counterclockwise as viewed from FIG. 3). In some embodiments, the obtuse angle 342 extending between the cyclonic chamber 30 and the motor assembly 114 is within a range of approximately 90 degrees to approximately 165 degrees. In alternative embodiments, the obtuse angle 342 extending between the cyclonic chamber 30 and the motor assembly 114 is within a range of approximately 135 degrees to approximately 150 degrees. In further alternative embodiments, the obtuse angle 342 extending between the cyclonic chamber 30 and the motor assembly 114 is approximately 140 to 145 degrees.

With reference to FIG. 1, the dirt collection region 38 is configured to receive debris from the dirt outlets 306, 334 that has been separated in the cyclonic chamber 30. Specifically, the dirt collection region 38 receives debris separated by the primary cyclonic stage 314 at the dirt outlet 306 and receives debris separated by the secondary cyclonic stage 318 at the dirt outlet 334. In the illustrated embodiment, the dirt collection region 38 includes an expanded portion 346. The dirt collection region 38 includes a bottom door 350 that is openable to empty out the dirt collection region 38. In particular, a latch 354 secures the door 350 in a closed position and the latch 354 is actuated to pivot the door 350 about a pivot 358 to an open position.

Figure 7:
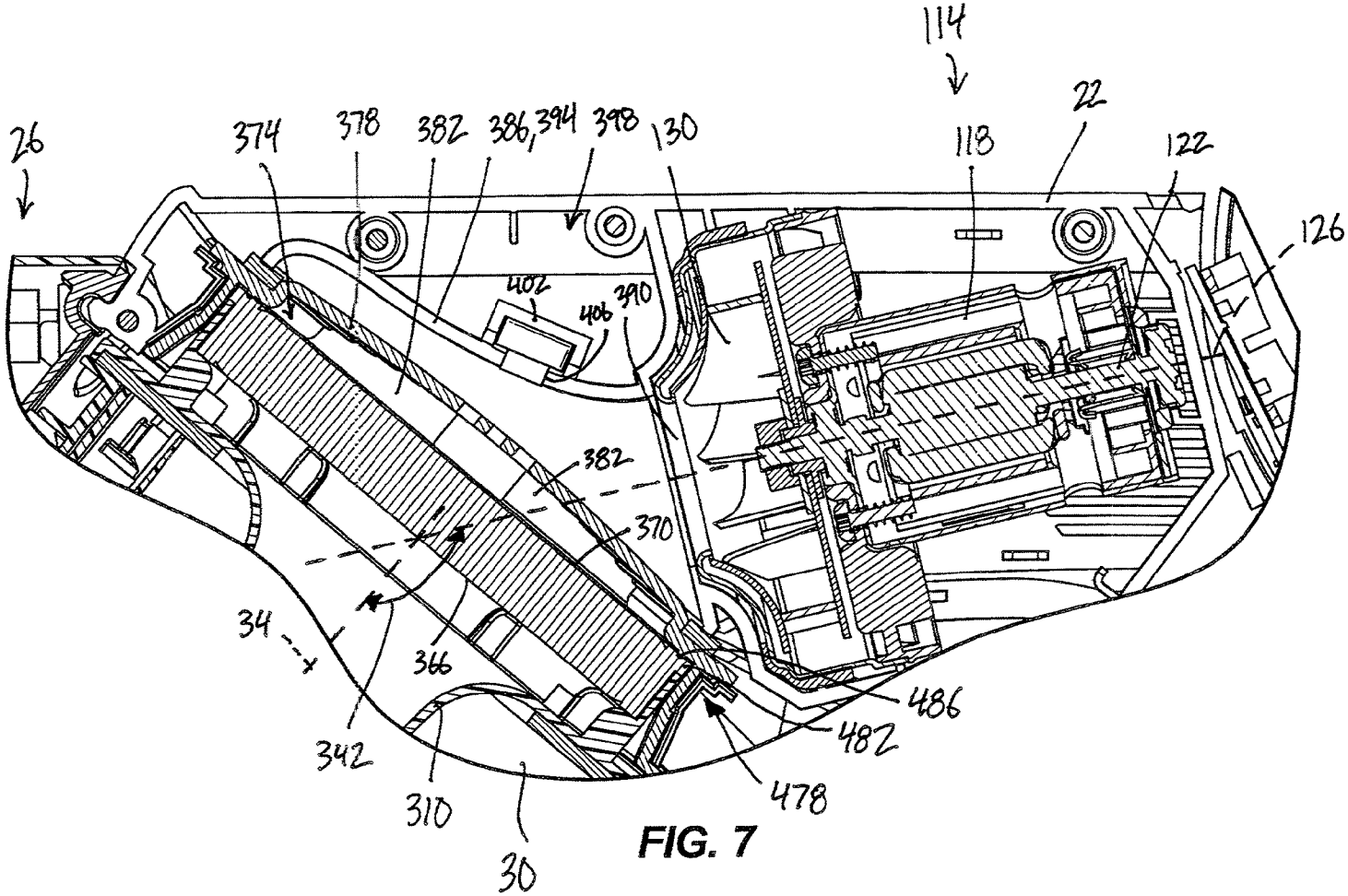
FIG. 7 is a partial cross-sectional view of the handheld vacuum cleaner of FIG. 1.

With reference to FIG. 7, the cyclonic separator assembly 26 further includes a pre-motor filter 362 in the fluid flow path downstream from the cyclonic chamber 30 and upstream from the motor assembly 114. Specifically, the pre-motor filter 362 includes an upstream surface 366 facing the cyclonic clean fluid outlet 310 and a downstream surface 370 opposite the upstream surface 366. The pre-motor filter 362 is positioned within a filter chamber 374 downstream of the cyclonic clean fluid outlet 310. In the illustrated embodiment, the motor rotational axis 126 and the separator axis 34 intersect at or below the pre-motor filter 362. The filter chamber 374 further includes a screen 378 and a plurality of ribs 382 positioned between the screen 378 and the pre-motor filter 362.

With continued reference to FIG. 7, a plenum 386 is in the fluid flow path immediately upstream from the motor assembly 114. In the illustrated embodiment, the plenum 386 is positioned within the main body 22 and is immediately downstream of the pre-motor filter 362 and the screen 378. In other words, the screen 378 is positioned between the pre-motor filter 362 and the plenum 386. The plenum 386 is funnel-shaped and may be referred to as a bell-mouth plenum. The plenum 386 directs the airflow from the pre-motor filter 362 to an inlet 390 to the motor assembly 114. The inlet 390 to the motor assembly 114 is open and the screen 378 is positioned upstream and spaced from the open motor inlet 390. In some embodiments, the fluid flow path through the plenum 386 includes a volumetric flow rate of at least 20 cubic feet per minute (CFM) measured at the suction inlet (i.e., the inlet aperture 226). The plenum 386 includes a wall portion 394 facing the downstream surface 370 of the pre-motor filter 362. A cavity 398 is formed between the plenum 386 and the main body 22.

With continued reference to FIG. 7, the handheld vacuum cleaner 10 further includes a sensor 402 operable to measure a characteristic of the fluid flow path (e.g., air pressure, volumetric air flow rate, etc.). In the illustrated embodiment, the sensor 402 is positioned on the plenum 386. Specifically, the sensor 402 is positioned on the wall portion 394 of the plenum 386 facing the downstream surface 370 of the pre-motor filter 362. In other words, the sensor 402 is positioned within the cavity 398, with at least a portion of the sensor 402 in fluid communication with the airflow within the plenum 386 via an aperture 406 formed in the plenum 386. In alternative embodiments, the sensor 402 may be positioned in a different location along the air flow path. Additionally, more than one sensor 402 may be utilized to measure one or more air flow characteristics. As described in greater detail below, the measurements from the sensor 402 are utilized to control the handheld vacuum cleaner 10.

Figure 9:
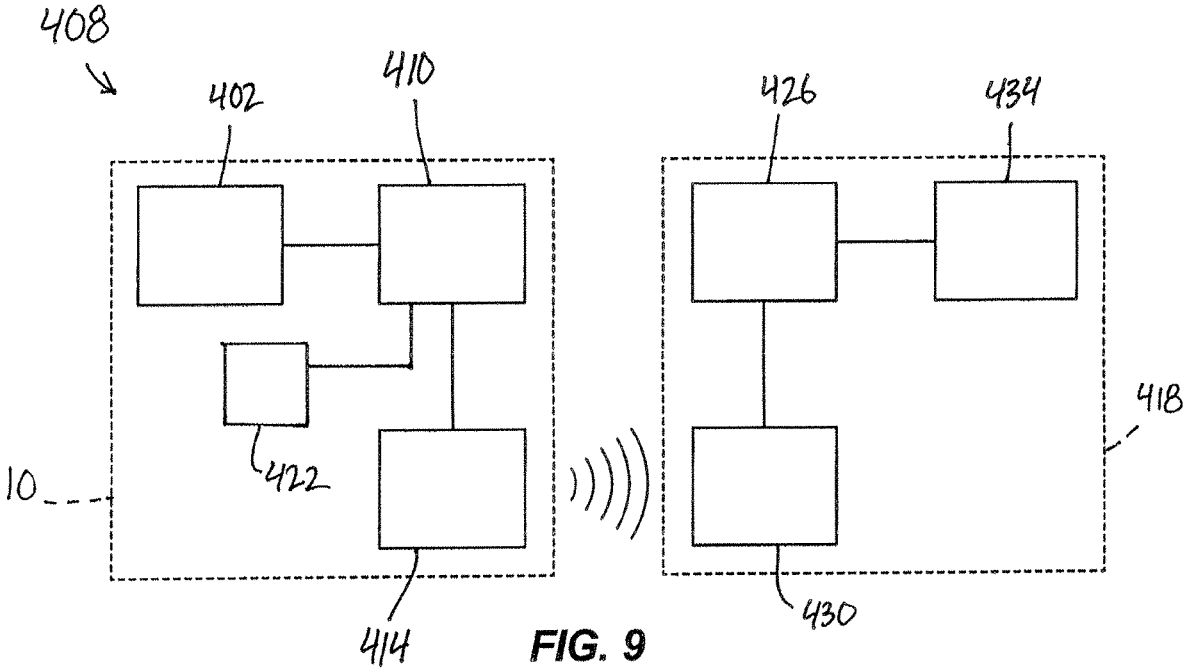
FIG. 9 is a schematic view of an alert transmission system for the handheld vacuum cleaner of FIG. 1.

With reference to FIG. 9, a schematic of an information transmission system 408 is illustrated. The information transmission system 408 includes the vacuum controller 410 (e.g., microprocessor, etc.), the sensor 402, and a transmitter 414. As explained in greater detail below, the handheld vacuum cleaner 10 includes the transmitter 414, which is electrically coupled to the controller 410, and the transmitter 414 is operable to transmit a wireless communication signal (e.g., via radio signal, Wi-fi®, Bluetooth®, or any other wireless internet or network communication) providing information to a personal device 418 of a user. Specifically, the personal device 418 includes a device controller 426, a receiver 430 electrically coupled to the device controller 426, and a display 434 electrically coupled to the controller 426. In particular, the receiver 430 is configured to receive the information transmitted by the transmitter 414, and the display 434 is configured to provide a display to the user in response to the information. For example, the vacuum controller 410 monitoring the sensor 402 may provide an alert to the visual indicator 422 and to the personal device 418 through the transmitter 414 if the sensor indicates that the filter needs maintenance or if the system has a clog. In some embodiments, the personal device 418 is a cell phone. In other embodiments, the personal device 418 is a personal computer.

Figure 8:
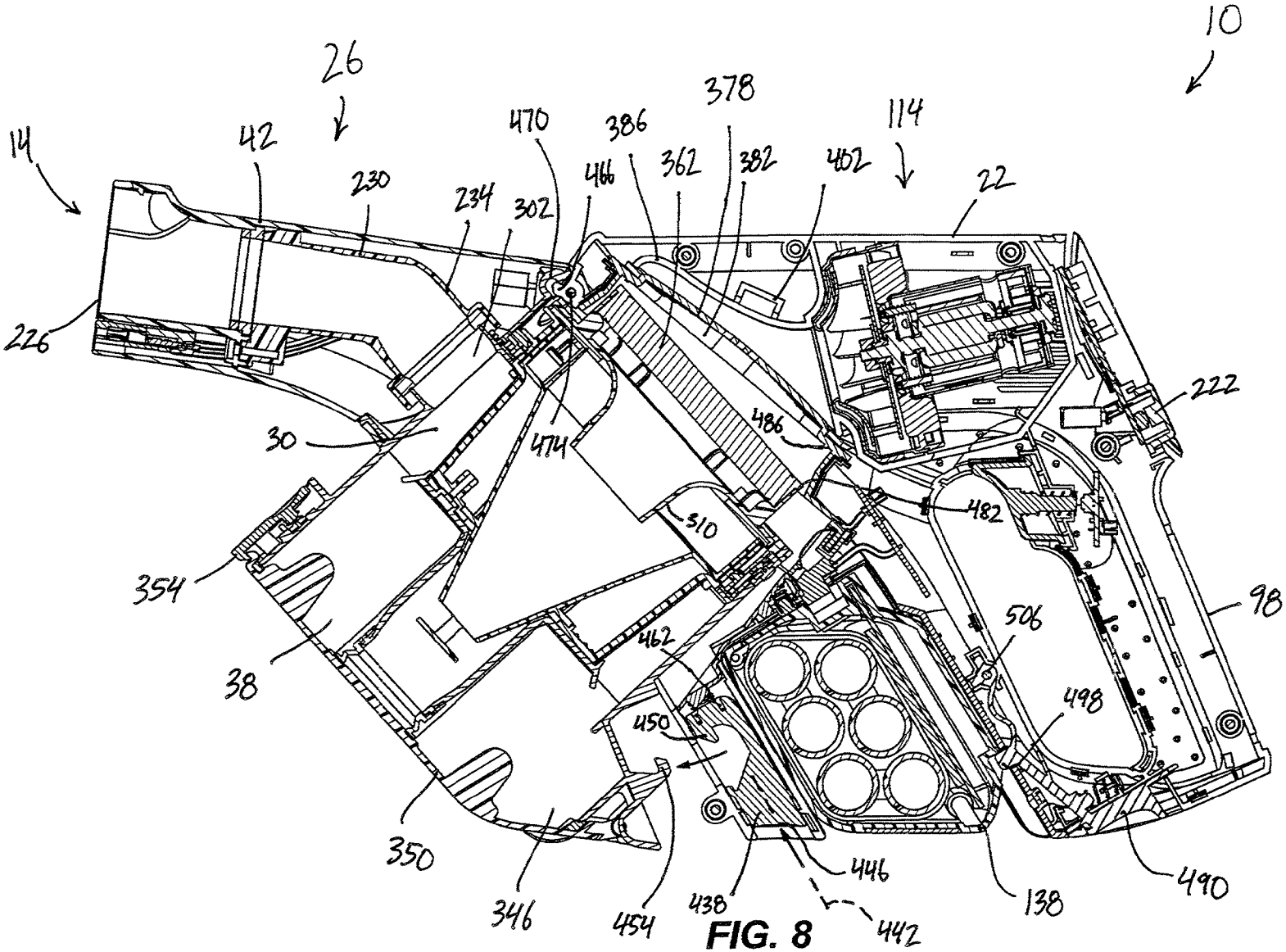
FIG. 8 is a cross-sectional view of the handheld vacuum cleaner of FIG. 1, with a cyclonic separator assembly partially removed from a main body.

With reference to FIG. 8, the cyclonic separator assembly 26 is removable from the main body 22. In particular, the inlet nozzle 42, the cyclonic chamber 30, and the dirt collection region 38 are removed as a single unit when the cyclonic separator assembly 26 is removed from the main body 22. In other words, the dirty air inlet 14 and the cyclonic chamber 30 are part of the cyclonic separator assembly 26. A release actuator 438 is configured to release the cyclonic separator assembly 26 from the main body 22 when actuated by a user. In the illustrated embodiment, the release actuator 438 is positioned on and accessible from the bottom 94 of the main body 22. In addition, the actuator 438 is positioned between the cyclonic separator assembly 26 and the battery 138. Specifically, the actuator 438 is positioned between the expanded portion 346 of the dirt collection region 38 and the battery 138.

With reference to FIGS. 4 and 8, the release actuator 438 is movable between a locking position (FIG. 4) that prevents removal of the cyclonic separator assembly 26 from the main body 22, and a released position (FIG. 8) that allows removal of the cyclonic separator assembly 26 from the main body 22. Movement of the actuator 438 between the locking position and the released position is along an actuation axis 442. In the illustrated embodiment, the actuation axis 442 is parallel to the battery insertion axis 158. Specifically, the actuator 438 includes a user-actuated portion 446 and a locking portion 450 that engages the cyclonic separator assembly 26 when the actuator 438 is in the locking position (FIG. 4). In particular, the locking portion 450 engages a corresponding hook portion 454 formed on the cyclonic separator assembly 26 when the actuator 438 is in the locking position. In addition, the locking portion 450 includes an inclined surface 458 such that when the cyclonic separator assembly 26 is being coupled to the main body 22, the hook portion 454 on the cyclonic separator assembly 26 engages the inclined surface 458 to move the actuator 438 to the released position. A spring 562 is positioned between the actuator 438 and the main body 22 to bias the actuator 438 toward the locking position.

With continued reference to FIG. 8, a lip 466 is formed on the main body 22 and the inlet nozzle 42 includes a corresponding notch 470. In alternative embodiments, the lip is formed on the inlet nozzle 42 and the corresponding notch is formed on the main body 22. In the illustrated embodiment, the lip 466 is received within the notch 470 when the cyclonic separator assembly 26 is coupled to the main body 22. In particular, the cyclonic chamber 30 is positioned between the lip 466 and the actuator 438 when the cyclonic separator assembly 26 is coupled to the main body 22. The lip 466 and the notch 470 define a pivot axis 474 about which the cyclonic separator assembly 26 is configured to pivot with respect to the main body 22. To secure the cyclonic separator assembly 26 to the main body 22, the lip 466 is inserted into the notch 470 to provide support of the cyclonic separator assembly 26 at the top 90 of the main body 22. Then, the cyclonic separator assembly 26 is pivoted about the axis 474 toward the main body 22 until the actuator 438 securely engages with the hook portion 454 formed on the cyclonic separator assembly 26. Likewise, to remove the cyclonic separator assembly 26, a user depresses the user-actuated portion 446 of the actuator 438 to release the hook portion 454. Once released, the cyclonic separator assembly 26 pivots about the axis 474 away from the main body 22 and then the notch 470 is separated from the lip 466 on the main body 22. When the cyclonic separator assembly 26 is removed from the main body 22, the downstream surface 370 of the pre-motor filter 362 is exposed on the cyclonic separator assembly 26 and the screen 378 is exposed on the main body 22.

With continued reference to FIGS. a seal 478 is made between the main body 22 and the cyclonic separator assembly 26 when the cyclonic separator assembly 26 is coupled to the main body 22. In the illustrated embodiment, the seal 478 is the only seal made between the cyclonic separator assembly 26 and the main body 22, thereby minimizing the potential for leaks. Compression of the pre-motor filter 362 forms the seal 478 between the main body 22 and the cyclonic separator assembly 26. In particular, the pre-motor filter 362 includes a circumferential face or flange 482 around an outer periphery of the pre-motor filter 362 that is compressed to form the seal 478. The main body 22 may include a corresponding protrusion 486 (e.g., an annular rib) that engages the flange portion 482 of the pre-motor filter 362 when the cyclonic separator assembly 26 is coupled to the main body 22. In other words, the annular rib 486 compresses the face or flange 482 on the pre-motor filter 362 to create an air-tight seal between the cyclonic separator assembly 26 and the main body 22. The face or flange 482 may include an elastomeric surface integral with the filter 362 forming the contacting surface to the main body.

Figure 5A:
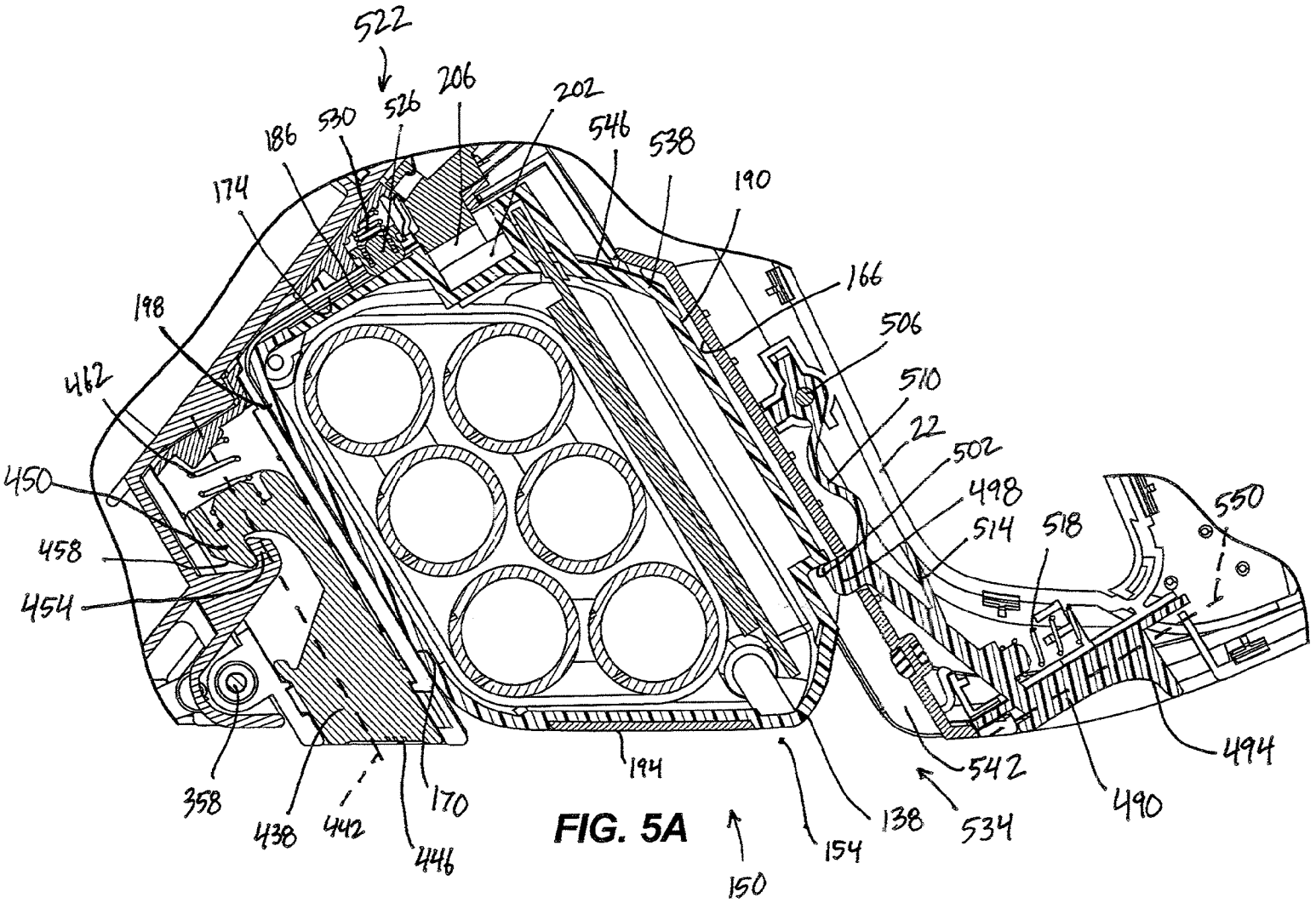
FIG. 5A is a partial cross-sectional view of the handheld vacuum cleaner of FIG. 1, illustrating a battery latch in a locked position.
Figure 5B:
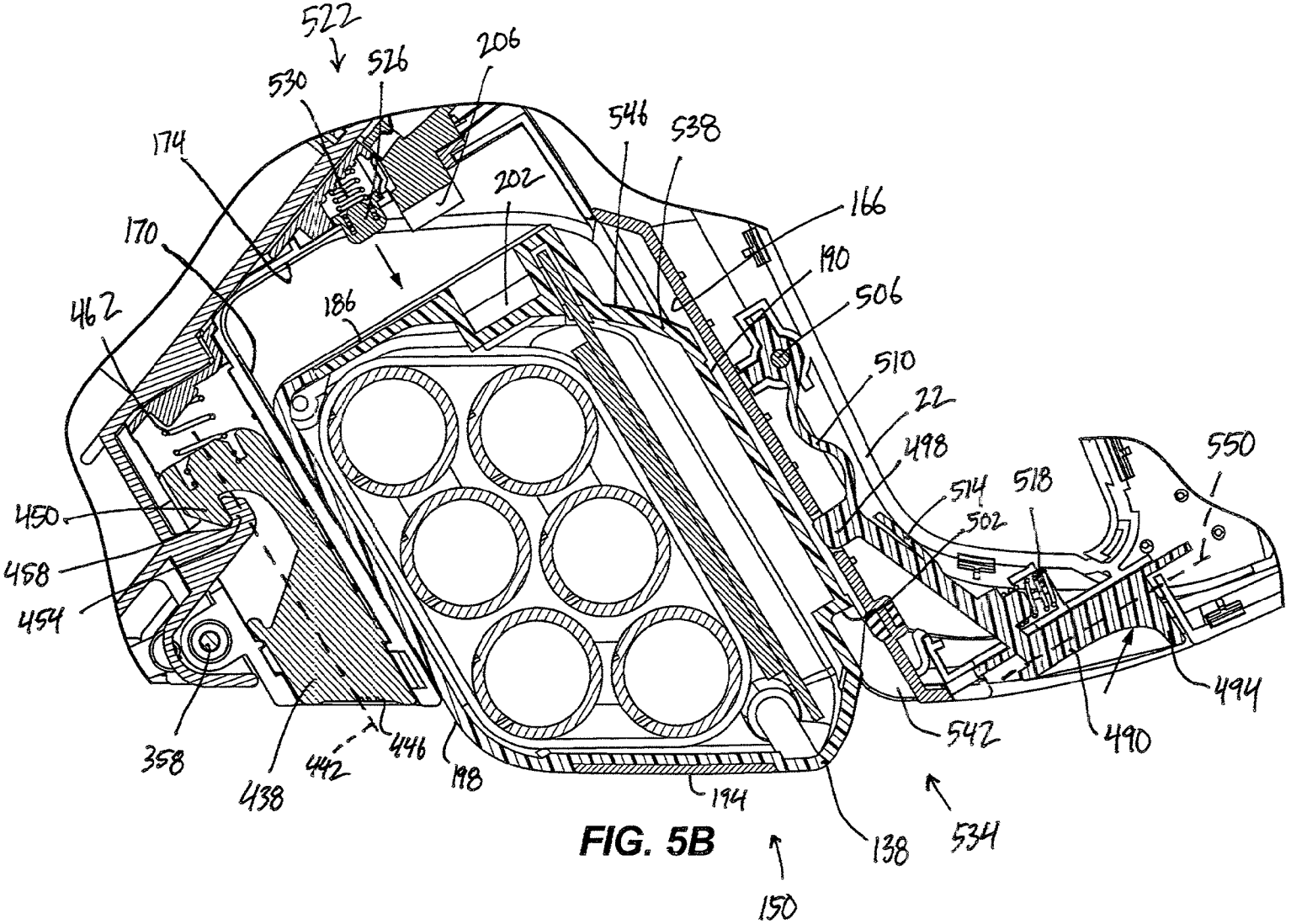
FIG. 5B is a partial cross-sectional view of the handheld vacuum cleaner of FIG. 1, illustrating the battery latch in a released position.

With reference to FIGS. 5A-5B, the battery receptacle 150 includes a latch 490 movable between a blocking position (FIG. 5A) that prevents removal of the battery 138 from the receptacle 150, and a released position (FIG. 5B) that allows removal of the battery 138 from the receptacle 150. The latch 490 is a single integrally molded part. In other words, the latch 490 elastically deforms to move between the blocking position (FIG. 5A) and the released position (FIG. 5B). In the illustrated embodiment, the latch 490 flexes between the blocking position and the released position as a cantilever. The latch 490 includes a user-actuated portion 494 and a locking portion 498 that engages the battery 138 when the latch 490 is in the blocking position. Specifically, the locking portion 498 abuts a surface 502 of the battery 138 when the latch 490 is in the blocking position.

In addition, the latch 490 includes a fixed connection 506 secured to the main body 22. The locking portion 498 of the latch 490 is positioned between the fixed connection 506 and the user-actuated portion 494. More specifically, the locking portion 498 includes a connecting portion 510 extending to the fixed connection 506. In the illustrated embodiment, the connecting portion 510 is wave-shaped. The connecting portion 510 deforms when the latch 490 moves between the blocking and released portions. Optionally, the latch 490 also includes a spring 514 formed integrally with the latch 490 (e.g., an integrally molded spring) that pushes the latch 490 toward the blocking position. The spring 514 contacts the main body 22 pressing the latch 490 toward the blocking position. Additional springs, such as a spring 518 (separate from the latch 490) may be positioned between the latch 490 and the main body 22 to further position the latch 490 toward the blocking position. As such, the connecting portion 510, the spring 514, and the spring 518 each urge the latch 490 toward the blocking position.

With continued reference to FIG. 5A, the battery receptacle 150 further includes an eject assist assembly 522 that presses the battery 138 away from the electrical contacts 202 and out of a position engagable by the locking portion 498. In other words, the eject assist assembly 150 aids in the removal of the battery 138 from the receptacle 150 when the battery 138 is released from the main body 22. In particular, the eject assist assembly 522 includes an ejector 526 (e.g., an elastomeric cover) and a spring 530 that pushes the ejector 526 toward the receptacle 150. The ejector 526 is configured to extend into the receptacle 150 when the battery 138 is removed from (i.e., not positioned completely within) the receptacle 150. As such, when the user actuates the latch 490 to release the battery 138, the ejector 526 pushes the battery 138 out of a position engagable by the locking portion 498 so that the user can remove the unlatched battery.

With continued reference to FIG. 5B, the battery receptacle 150 and the battery 138 are coupled together upon insertion of the battery 138 in the receptacle 150 by a tongue and groove connection 534. One of the fourth surface 198 and the second surface 190 is coupled to the main body 22 with the tongue and groove connection 534 when the battery 138 is positioned within the receptacle 150. In the illustrated embodiment, the second surface 190 of the battery 138 includes a tongue 538 of the tongue and groove connection 534, and the first wall 166 of the receptacle 150 includes a corresponding groove 542 of the tongue and groove connection 534. In alternative embodiments, the tongue is positioned on the receptacle 150 and the groove is positioned on the battery 138.

In addition, the battery 138 includes a ramp 546 that moves the latch 490 from the blocking position to the released position when the battery 138 is inserted into the receptacle 150. In other words, when the battery 138 is inserted into the receptacle 150, engagement of the locking portion 498 with the ramp 546 causes the latch 490 to deflect to the released position (FIG. 5B) until the battery 138 is fully inserted. Once the battery 138 is fully inserted into the receptacle 150, the latch 490 is biased back into the locking state (FIG. 5A) by at least the spring 514, the spring 518, or the connecting portion 510.

Actuation of the user-actuated portion 494 deflects the locking portion 498 to the released position (FIG. 5B). In particular, the user-actuated portion 494 of the latch 490 is constrained by the main body 22 to translate along a single axis 550 only. When the user-actuated portion 494 is translated along the axis 550, in one example sliding in a direction away from the battery, the remaining portions of the latch 490 elastically deform or deflect such that the locking portion 498 is moved to the released position. In the released position (FIG. 5B), the locking portion 498 is spaced from the surface 502 on the battery 138 disengaged from the battery. In some embodiments, the single axis 550 is transverse to the direction of the battery insertion axis 158. In other embodiments, the single axis 550 is generally along the battery insertion axis 158, in which case the user-actuated portion of the latch is pulled toward the user. Once released, the eject assist assembly 522 at least partially ejects the battery 138 from the receptacle 150 and the user is able to remove the battery 138 completely from the receptacle 150. Various latch shapes may be configured to provide elastic deformation causing the locking portion to move to the released position when the user-actuated portion is moved in a direction desired for the application.

Figure 11:
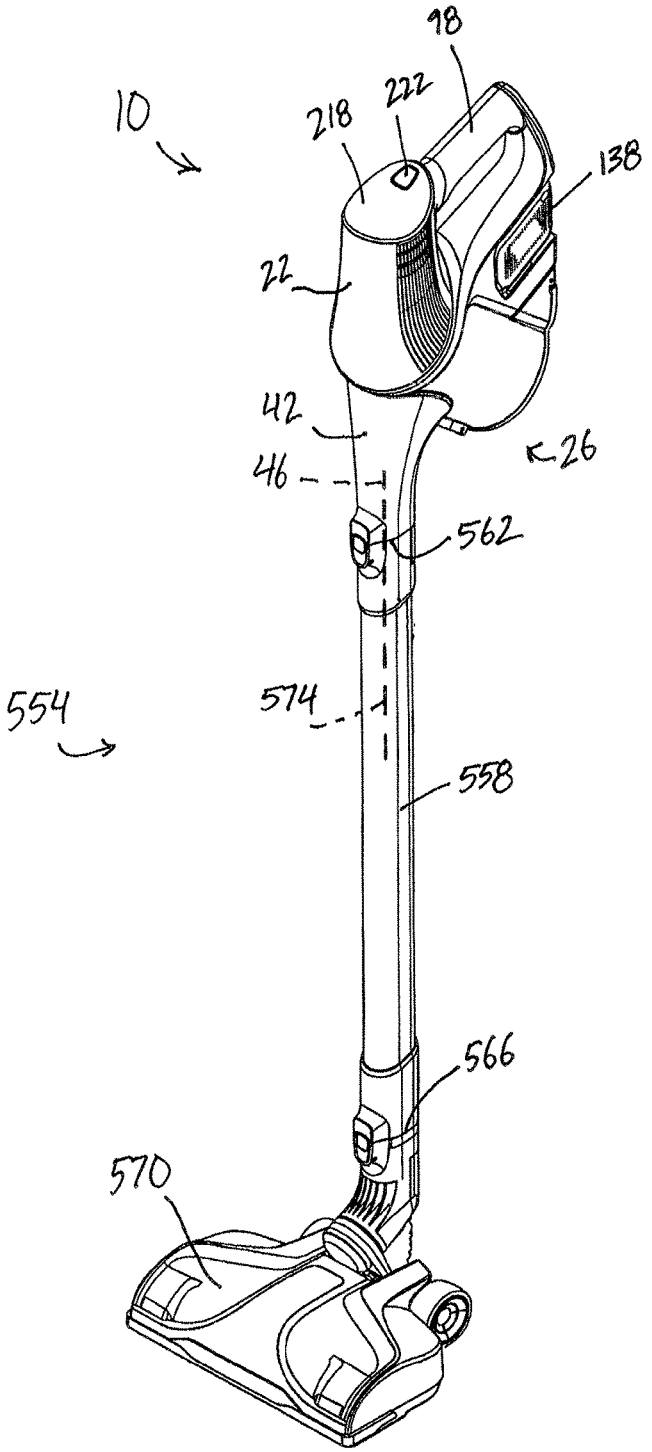
FIG. 11 is a perspective view of the handheld vacuum cleaner of FIG. 1 coupled to a surface cleaning attachment according to an embodiment of the invention.
Figure 12:
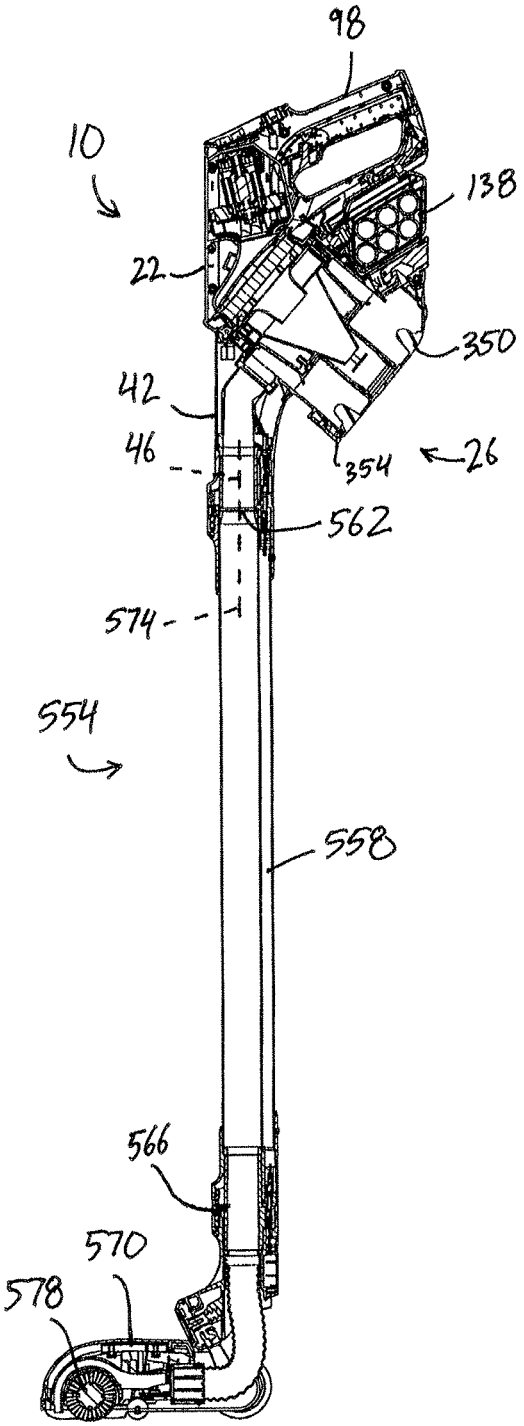
FIG. 12 is a cross-sectional view of the handheld vacuum cleaner and the surface cleaning attachment of FIG. 11, in a stored position.

With reference to FIGS. 11-13, the handheld vacuum cleaner 10 is operable with a cleaning attachment. Specifically, the inlet nozzle 42 is selectively coupled to the cleaning attachment. In the illustrated embodiment, the cleaning attachment is a surface cleaning attachment 554 with a rigid wand 558 having an end 562 mounted to the dirty air inlet 14 and an opposed end 566 mounted on a surface cleaning head 570. The wand 558 is linear and defines a wand axis 574. The wand axis 574 is collinear with the inlet axis 46. As described above, the bottom door 350 of the cyclonic separator assembly 26 is openable, even when the wand 558 is mounted to the dirty air inlet 14. In alternative embodiments, the handheld vacuum cleaner 10 is coupled to alternative cleaning attachments (e.g., extension wands, mini surface cleaning heads, crevice tools, etc.).

With reference to FIG. 12, the handheld vacuum cleaner 10 may be stored with the surface cleaning attachment 554 in an upright, stored position. With reference to FIG. 13, the separator axis 34 is vertical when the handheld vacuum cleaner 10 is attached to the surface cleaning attachment 554 and oriented in an inclined, in-use position. Since the separator axis 34 is vertical when the handheld vacuum cleaner 10 is in the in-use position (FIGS. 4 and 13), the effectiveness of the cyclonic chamber 30 during use (i.e., operation) is improved. In other words, operation of the cyclonic chamber 30 is improved when the separator axis 34 remains vertical during use (i.e., when the handheld vacuum cleaner 10 is being used as a handheld (FIG. 4), or with a surface cleaning attachment 554 (FIG. 13)).

With continued reference to FIGS. 1 and 12, the inlet nozzle 42 includes the electrical connection 286 proximate the dirty air inlet 14. The electrical connection 286 provides electrical power to the cleaning attachment. In the illustrated embodiment, the electrical connection 286 provides electrical power to rotate a brushroll 578 positioned within the surface cleaning head 570. In alternative embodiments, the electrical connection 286 may provide electrical power to a light, sensor, or other electrical components in the cleaning attachment.

In the embodiment illustrated in FIG. 3, the trigger 100 actuates a micro-switch in electrical communication with the vacuum controller 410. Upon user activation of the trigger 100, the micro-switch provides an electrical output to the controller 410 signaling for the controller to activate the vacuum. The vacuum controller may be configured to provide power while the user holds the trigger against the micro-switch. In one embodiment, the controller 410 is programmed to identify two actuations of the trigger within a short period, for example, two actuations of the trigger within 1 second, or 1.5 second, or 2 second, indicating a double tap of the trigger. When the vacuum controller receives a double tap of the trigger, the vacuum controller provides power without the user holding the trigger, remaining on until the user actuates the trigger again.

As such, the controller 410 includes instructions for a method of controlling the handheld vacuum cleaner 10 that includes monitoring a user activated switch (i.e., the trigger 100 and/or the micro-switch), and activating the motor 118 providing airflow along the fluid flow path while the user activated switch is activated. The method further includes determining when the user activated switch is activated by a user twice within a predetermined period of time (i.e., 1 second, 1.5 seconds, 2 seconds, etc.), and continuously activating the motor without further activation of the user activated switch upon determining the user activated switch has been activated twice within the predetermined period of time. The method further includes deactivating the motor 118 upon the next activation of the user activated switch. In other words, when the user activated switch is activated twice in the predetermined period of time, the motor 118 will operate continuously until the user activates the user activated switch a third time.

In operation, upon user activation of the trigger 100, the battery 138 provides power to the motor 118 to rotate the fan 130, generating a suction airflow drawn through the inlet nozzle 42 along with debris. The airflow, entrained with debris, travels into the cyclonic chamber 30 where the airflow and debris rotate about the separator axis 34. Rotation of the airflow and debris in the primary cyclonic stage 314 causes the debris to separate from the airflow and the debris is discharged through the dirt outlet 306. The separated debris then falls from the dirt outlet 306 into the dirt collection region 38. The clean air travels through the perforated shroud 322 into the secondary cyclonic stage 318 where debris is separated from the airflow and the debris is discharged through the dirt outlet 334 into the dirt collection region 38. The clean airflow then travels through the cyclonic clean air outlet 310 to the filter chamber 374, where the airflow then travels through the pre-motor filter 362. Downstream of the pre-motor filter 362 the airflow is routed by the plenum 386 to the input 390 to the motor assembly 114. After traveling through the motor assembly 114, the airflow is exhausted from the handheld vacuum cleaner 10 through the clean air outlet 18 formed in the main body 22.

After using the handheld vacuum cleaner 10, the user can open the door 350 to empty the dirt collection region 98. After several uses, debris may have collected on, for example, the shroud 322 or generally within the cyclonic chamber 30. If so, the user can remove the cyclonic separator assembly 26 from the main body 22 by depressing the actuator 438. Removing the cyclonic separator assembly 26 from the main body 22 provides improved access to the cyclonic chamber through either the filter chamber 374 or the bottom door 350.

Figure 10:
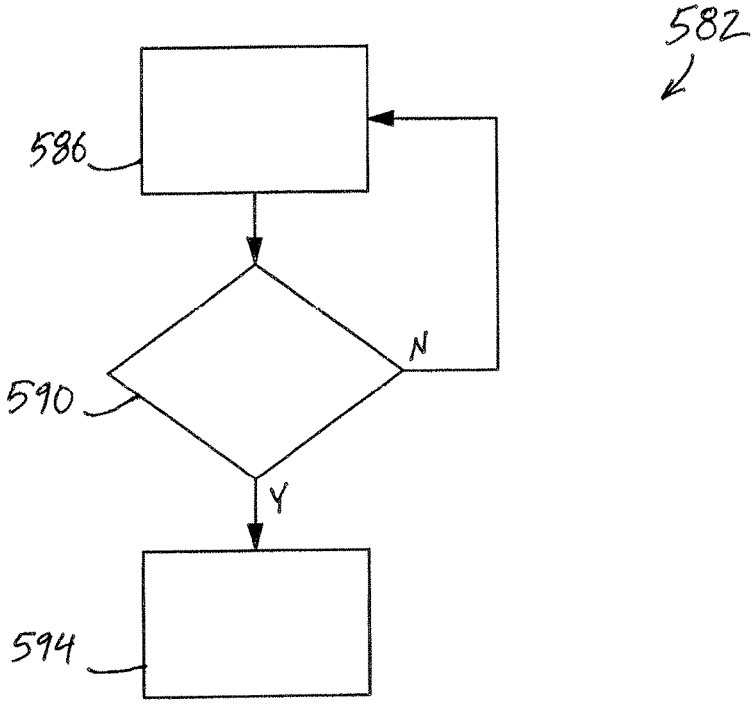
FIG. 10 is a flow chart illustrating a method of controlling the handheld vacuum cleaner of FIG. 1.

As described above, the sensor 402 measures a characteristic of the airflow and is used in a method 582 of controlling the handheld vacuum cleaner 10 (FIG. 10). The method 582 includes measuring a pressure value of the airflow through the fluid flow path (step 586). Specifically, measuring the pressure value of the airflow is measured downstream of the pre-motor filter 362, within the plenum 386. The method 582 also includes determining whether the pressure value exceeds a predetermined threshold, which is indicative of a clog within the fluid flow path (step 590). When the pressure value exceeds the predetermined threshold, the method 582 includes alerting a user of the vacuum cleaner (step 594). Alerting the user at step 594 includes transmitting an alert to the personal device 418 (e.g., cell phone, personal computer, etc.) of the user and, optionally, providing to the personal device information identifying to the user a plurality of possible clog locations along the fluid flow path on the display 434. In some embodiments, transmitting an alert to the personal device 418 is transmitted with direct vacuum-to-device wireless data communication (e.g., Wi-Fi®, Bluetooth®, or other radio signal). In other embodiments, transmitting an alert to the personal device 418 is transmitted via wired or wireless internet or network communication. The alert also includes instructions for the user to clean the possible clog locations along the fluid flow path to remove the clog, which are illustrated on the device display 434. Alerting the user further includes activating the visual indicator 422 positioned on the handheld vacuum cleaner 10. In some embodiments, the method 582 may further include the step of disabling the airflow through the fluid flow path when the pressure value exceeds the predetermined threshold. In some embodiments, the controller 426 is executing instructions in the form of an application program (a.k.a. an app), which enables the user to interface with the handheld vacuum cleaner 10 through the display 434.

Various features and advantages of the invention are set forth in the following claims.

What is claimed is:

1. A handheld vacuum cleaner comprising:

a main body including a handle;

a motor assembly positioned within the main body; and a cyclonic separator assembly removably coupled to the main body, the cyclonic separator assembly including an inlet nozzle having a dirty air inlet positioned at a front of the handheld vacuum cleaner when the cyclonic separator assembly is coupled to the main body, the inlet nozzle defining an inlet axis, a cyclonic chamber in fluid communication with the dirty air inlet, the cyclonic chamber defining a separator axis, and a dirt collection region configured to receive debris separated in the cyclonic chamber;

wherein the inlet nozzle includes an upstream height measured perpendicular to the inlet axis and a downstream height measured parallel to the separator axis, and wherein the downstream height is larger than the upstream height;

wherein the dirty air inlet includes a first air tube and a second air tube housed within the inlet nozzle, the first air tube including an inlet aperture and the inlet nozzle is wider than the first air tube at the inlet aperture.

2. The handheld vacuum cleaner of claim 1, wherein the upstream height is measured at a minimum height at the inlet nozzle.

3. The handheld vacuum cleaner of claim 1, wherein the downstream height is at least 1.3 times larger than the upstream height.

4. The handheld vacuum cleaner of claim 1, wherein the downstream height is in the range from 1.5 to 3 times larger than the upstream height.

5. The handheld vacuum cleaner of claim 1, wherein an upstream portion having a first cross-sectional area and a downstream portion having a second cross-sectional area, and wherein the second cross-sectional area is at least 1.5 times larger than the first cross-sectional area.

6. The handheld vacuum cleaner of claim 5, wherein the second cross-sectional area is at least 3 times larger than the first cross-sectional area.

7. The handheld vacuum cleaner of claim 1, wherein the cyclonic separator assembly defines a separator height that extends along the separator axis, and wherein the downstream height is greater than one half of the separator height.

8. The handheld vacuum cleaner of claim 1, wherein the dirty air inlet includes a first air passage defining a first axis and a second air passage downstream of the first air passage, the second air passage defining a second axis, and wherein the first axis and the second axis intersect to form an angle as viewed from a vertical cross-section taken from a lateral side of the handheld vacuum cleaner.

9. The handheld vacuum cleaner of claim 8, wherein the second air passage includes a tangential inlet to the cyclonic chamber.

10. The handheld vacuum cleaner of claim 1, further comprising a wand having an end mounted to the dirty air inlet and an opposed end mounted on a surface cleaning head.

11. The handheld vacuum cleaner of claim 10, wherein the cyclonic separator assembly further includes a bottom that is openable when the wand is mounted to the dirty air inlet.

12. The handheld vacuum cleaner of claim 10, wherein at the dirty air inlet the inlet nozzle includes a space outside the first air tube.

13. The handheld vacuum cleaner of claim 12, wherein the inlet nozzle includes an electrical connection positioned in the space and configured to provide electrical power to the surface cleaning head through the wand.

14. The handheld vacuum cleaner of claim 12, wherein the wand includes a latch received in the space.

15. The handheld vacuum cleaner of claim 14, wherein the wand is latched to the inlet nozzle such that the surface cleaning head is in fluid communication with the cyclonic chamber through the first air tube and the second air tube.

16. The handheld vacuum cleaner of claim 1, wherein the inlet nozzle is selectively coupled to a cleaning attachment, and wherein the inlet nozzle includes an electrical connection to provide electrical power to the cleaning attachment.

17. A handheld vacuum cleaner comprising:

a main body including a handle;

a motor assembly positioned within the main body; and a cyclonic separator assembly removably coupled to the main body, the cyclonic separator assembly including an inlet nozzle having a dirty air inlet positioned at a front of the handheld vacuum cleaner when the cyclonic separator assembly is coupled to the main body, the inlet nozzle defining an inlet axis, a cyclonic chamber in fluid communication with the dirty air inlet, the cyclonic chamber defining a separator axis, and a dirt collection region configured to receive debris separated in the cyclonic chamber;

wherein the inlet nozzle includes an upstream height measured perpendicular to the inlet axis and a downstream height measured parallel to the separator axis, and wherein the downstream height is larger than the upstream height;

wherein the dirty air inlet includes a first air tube and a second air tube housed within the inlet nozzle, wherein the inlet nozzle extends from the cyclonic chamber, wherein the second air tube includes a tangential inlet to the cyclonic chamber, and wherein the tangential inlet is narrower than the inlet nozzle where the inlet nozzle meets the cyclonic chamber.

* * * * *